US007071769B1

(12) United States Patent
Aram

(10) Patent No.: US 7,071,769 B1
(45) Date of Patent: Jul. 4, 2006

(54) FREQUENCY BOOSTING CIRCUIT FOR HIGH SWING CASCODE

(75) Inventor: Farbod Aram, Los Altos Hills, CA (US)

(73) Assignee: Marvell International Ltd., Hamilton (BM)

( * ) Notice: Subject to any disclaimer, the term of this patent is extended or adjusted under 35 U.S.C. 154(b) by 0 days.

(21) Appl. No.: 10/788,618

(22) Filed: Feb. 27, 2004

(51) Int. Cl.
*G05F 1/10* (2006.01)

(52) U.S. Cl. ..... 327/543; 327/552

(58) Field of Classification Search ..... 323/315, 323/316; 327/536, 538, 543, 551, 552, 558, 327/559

See application file for complete search history.

(56) References Cited

U.S. PATENT DOCUMENTS 5,381,034 A 1/1995 Thrower et al.
5,471,172 A 11/1995 Chiu et al.
5,590,748 A 1/1997 Chang
5,825,244 A 10/1998 Somayajula
5,834,976 A 11/1998 Tomasini et al.
6,369,554 B1 4/2002 Aram
6,690,229 B1 * 2/2004 Rudolph ..... 327/543
6,756,847 B1 6/2004 Blecker et al.
6,803,803 B1 10/2004 Starr et al.

OTHER PUBLICATIONS

Bhupendra K. Ahuja, "An Improved Frequency Compensation Technique for CMOS Operational Amplifiers", IEEE Journal of Solid-State Circuits, vol. SC-18, No. 6, Dec. 1983, pp. 629-633.
U.S. Appl. No. 10/789,306, filed Feb. 27, 2004, Aram.
U.S. Appl. No. 11/170,926, filed Jun. 30, 2005, Aram.
U.S. Appl. No. 11/097,530, filed Apr. 1, 2005, Aram.

* cited by examiner

*Primary Examiner*—Jeffrey Zweizig

(57) ABSTRACT

A high swing cascode biasing circuit includes a current biasing circuit that generates a cascode bias and a main bias. A frequency boosting circuit receives the cascode bias and the main bias. A current mirror circuit receives the main bias. The frequency boosting circuit biases the current mirror and receives feedback from the current mirror.

19 Claims, 9 Drawing Sheets

FREQUENCY BOOSTING CIRCUIT FOR HIGH SWING CASCODE

CROSS-REFERENCE TO RELATED APPLICATIONS

This application is related to "Ahuja Compensation Circuit with Enhanced Bandwidth", U.S. patent application Ser. No. 10/789,306, filed Feb. 27, 2004, which is hereby incorporated by reference in its entirety.

FIELD OF THE INVENTION

The present invention relates to high swing cascode biasing circuits, and more particularly to high swing cascode biasing circuits with frequency boosting circuits.

BACKGROUND OF THE INVENTION

Various electronic devices such as but not limited to Ahuja compensation circuits include high swing cascode biasing circuits. These circuits include components such as capacitors, resistors and/or transistors that produce dominant and/or non-dominant poles. The relative location of the poles in the frequency domain may adversely impact the frequency response of the high swing cascode biasing circuit.

Referring now to FIG. 1, a high swing cascode biasing circuit 10 includes a biasing circuit 12 and a current mirror circuit 14. The biasing circuit 12 generates a cascode bias 15 and a main bias 16, which are output to the current mirror circuit 14. The biasing circuit 12 includes first, second, third and fourth transistors 18, 20, 24 and 26, respectively. In this implementation, the first, second, third, and fourth transistors 18, 20, 24, and 26, respectively, are metal-oxide semiconductor field-effect transistors (MOSFETs) that have gates, sources, and drains, although other transistor types may be used.

In one approach, a source (or second terminal) of the first transistor 18 communicates with a drain (or first terminal) of the second transistor 20. A gate (or control terminal) of the second transistor 20 communicates with a gate and a drain of the first transistor 18.

A source of the third transistor 24 communicates with a drain of the fourth transistor 26. A gate of the fourth transistor 26 communicates with a drain of the third transistor 24. The gate of the first transistor 18 communicates with the gate of the third transistor 24. The drains of the first and third transistors 18 and 24, respectively, communicate with first and second current sources 28 and 30, respectively. The first and second current sources 28 and 30, respectively, communicate with a supply potential 32. Sources of the second and fourth transistors 20 and 26, respectively, communicate with a ground potential 34.

The current mirror circuit 14 includes fifth and sixth transistors 36 and 38, respectively. A source of the fifth transistor 36 communicates with a drain of the sixth transistor 38. The gate of the third transistor 24 communicates with a gate of the fifth transistor 36. The gate of the fourth transistor 26 communicates with a gate of the sixth transistor 38. A first end of a first capacitor 40 communicates with the source of the fifth transistor 36. A second end of the first capacitor 40 and a source of the sixth transistor 38 communicate with the ground potential 34. A load current 42 flows into the drain of the fifth transistor 36.

Since the load current 42 may be part of a signal path 43, it is important for the pole that is associated with the fifth transistor 36 and the first capacitor 40 to occur at a high frequency. The bandwidth of the high swing cascode biasing circuit 10 is equal to $$\frac{1}{RC_L},$$

where R is resistance of the fifth transistor 36 and $C_L$ is the capacitance of the first capacitor 40. Since the resistance of the fifth transistor 36 is equal to $$\frac{1}{g_{m_1}},$$

where $g_{m_1}$ is the transconductance of the fifth transistor 36, the bandwidth is equal to $$\frac{1}{\left(\frac{1}{g_{m_1}}\right)C_L} = \frac{gl_{m_1}}{C_L}.$$

To increase bandwidth of the signal path 43, either the transconductance $g_{m1}$ of the fifth transistor 36 is increased or the capacitance $C_L$ of the first capacitor 40 is decreased. However, some applications such as Ahuja compensation circuits may require the capacitance $C_L$ to remain relatively fixed. In this case, the transconductance $g_{m1}$ of the fifth transistor 36 is increased to increase the bandwidth.

There are typically two ways to increase the transconductance $g_m$ of a transistor. First, a channel width of the transistor may be increased to increase the transconductance $g_m$ since the transconductance increases as the channel width increases. However, current also increases as the channel width increases. Increasing current also increases power dissipation, which is undesirable. Additionally, increasing the channel width increases parasitic capacitance.

Referring now to FIG. 2A, another way to increase the transconductance of the fifth transistor 36 is to create a feedback loop and to amplify the feedback. A high swing cascode biasing circuit 52 that is shown in FIG. 2A includes a frequency boosting circuit 53 that is located between the current biasing circuit 12 and the current mirror 14. The frequency boosting circuit 53 includes a feedback loop 56. The gate of a third transistor 24 no longer communicates with the gate of the fifth transistor 36 as shown in FIG. 1. A gate of a seventh transistor 58 communicates with the source of the fifth transistor 36. A drain of the seventh transistor 58 communicates with the gate of the fifth transistor 36.

A first end of a second capacitor 60 communicates with the drain of the seventh transistor 58. The drain of the seventh transistor 58 communicates with a third current source 62. A second end of the second capacitor 60 and a source of the seventh transistor 58 communicate with the ground potential 34. The third current source 62 communicates with the supply potential 32. By adding an amplifier in the feedback loop 56, the output impedance, $R_{out}$, of the feedback branch 54 is reduced. The transconductance of the fifth transistor 36 increases as the output impedance decreases.

The following discussion sets forth the bandwidth of the circuit in FIG. 2A. In order to derive the bandwidth, an open loop response technique is used. The open loop response technique provides information relating to the bandwidth and maximum achievable bandwidth of a circuit. The DC gain of the open loop response is determined by opening the feedback loop and attaching a voltage source to one end of the opened feedback loop. The output voltage is sensed at the other end of the opened feedback loop.

To derive the bandwidth, the DC gain of the open loop response and the first dominant pole $P_1$ are found. Assuming stable operation, there is only one pole $P_1$ that is located below a crossover frequency. The crossover frequency is the product of the DC gain of the open loop response and the first dominant pole $P_1$. The crossover frequency defines the bandwidth of the closed loop amplifier. The maximum available bandwidth is related to the second non-dominant pole $P_2$.

Referring now to FIG. 2B, the response of the open loop circuit of FIG. 2A is shown. The circuit has a first pole $$\frac{g_{m1}}{C_L}$$

and a second pole $$\frac{1}{R_{out}C_p}.$$

In FIG. 2B, we assume that the first pole $$\frac{g_{m1}}{C_L}$$

is dominant and that the second pole $$\frac{1}{R_{out}C_p}$$

is non-dominant. The DC gain of the open loop response is $g_{m2}R_{out}$. Multiplying the DC gain of the open loop response with the dominant pole $P_1$ results in the crossover frequency of $g_{m2}R_{out}$ $$\frac{g_{m1}}{C_L}.$$

The non-dominant pole at $$\frac{1}{R_{out}C_p}$$

relates to a barrier frequency or maximum achievable bandwidth. The crossover frequency $g_{m2}R_{out}$ $$\left(\frac{g_{m1}}{C_L}\right)$$

must be lower than the non-dominant pole, $$\frac{1}{R_{out}C_p},$$

for the circuit to be stable. Therefore, a significant limitation exists on the overall bandwidth when $$\frac{g_{m1}}{C_L}$$

is dominant.

In FIG. 2C, we will assume that the first pole $$\frac{g_{m1}}{C_L}$$

is non-dominant and that the second pole is dominant $$\frac{1}{R_{out}C_p}.$$

The DC gain of the open loop response is $g_{m2}R_{out}$. Multiplying the DC gain of the open loop response with the dominant pole $P_1$ results in the crossover frequency of $g_{m2}R_{out}$ $$\frac{1}{R_{out}C_p}.$$

The non-dominant pole at $$\frac{g_{m1}}{C_L}$$

relates to a barrier frequency or maximum achievable bandwidth.

It is desirable for the overall bandwidth, $$\frac{g_{m1}}{C_L},$$

to be high but $$\frac{g_{m_2}}{C_p}$$

must be lower than $$\frac{g_{m_1}}{C_L}$$

for the circuit to be stable. The operating frequency of the circuit is less than or equal to $$\frac{g_{m_2}}{C_p},$$

which is less than $$\frac{g_{m_1}}{C_L}.$$

Therefore, the frequency of the circuit never reaches $$\frac{g_{m_1}}{C_L}.$$

Additionally, the high swing cascode biasing circuit 52 in FIG. 2A dissipates more power than the high swing cascode biasing circuit 10 of FIG. 1 due to the addition of the amplified feedback loop 56.

SUMMARY OF THE INVENTION

A high swing cascode biasing circuit includes first, second, third, fourth, fifth, and sixth transistors, each with a first terminal, a second terminal, and a control terminal. The second terminals of the first, third and fifth transistors communicate with the first terminals of the second, fourth and sixth transistors. The first terminal of the first transistor communicates with the control terminals of the third and fifth transistors. The first terminal of the third transistor communicates with the control terminals of the fourth and sixth transistors. A resistance has a first end that communicates with the first terminal of the first transistor and a second end that communicates with the control terminals of the first and second transistors. A first capacitance has a first end that communicates with the control terminals of the first and second transistors and a second end that communicates with the second terminal of the fifth transistor and the first terminal of the sixth transistor. A second capacitance has a first end that communicates with the second terminal of the fifth transistor and the first terminal of the sixth transistor.

In other features, a third capacitance has a first end that communicates with the second terminal of the first transistor and a first terminal of the second transistor. The frequency boosting circuit is implemented in an Ahuja compensation circuit. The first, second, third, fourth, fifth, and sixth transistors are metal-oxide semiconductor field-effect transistors (MOSFETs).

In still other features, the resistance is one of a standard fixed-value resistor, a nonlinear variable resistor and a metal-oxide-semiconductor (MOS) resistor.

A high swing cascode biasing circuit comprises a current biasing circuit including first, second, third and fourth transistors. The second terminals of the first and third transistors communicate with the first terminals of the second and fourth transistors. The control terminal of the first transistor communicates with the control terminal of the second transistor. The first terminal of the third transistor communicates with the control terminal of the fourth transistor. A current mirror circuit includes fifth and sixth transistors each including a control terminal and first and second terminals and a first capacitance having one end connected between the second terminal of the fifth transistor and the first terminal of the sixth transistor. A resistance has one end that communicates with the first terminal of the first transistor and an opposite end that communicates with the control terminal of the first transistor. A second capacitance has one end that communicates with the control terminals of the first and second transistors and an opposite end that communicates with the one end of the first capacitance.

In other features, a third capacitance has one end that communicates with the second terminal of the first transistor and the first terminal of the first capacitance. The frequency boosting circuit is implemented in an Ahuja compensation circuit. The first, second, third and fourth transistors are metal-oxide semiconductor field-effect transistors (MOSFETs). The resistance is one of a standard fixed-value resistor, a nonlinear variable resistor and a metal-oxide-semiconductor (MOS) resistor.

A high swing cascode biasing circuit includes a current biasing circuit that generates a cascode bias and a main bias. A frequency boosting circuit receives the cascode bias and the main bias. A current mirror circuit receives the main bias.

The current mirror circuit includes a first transistor, a second transistor and a first capacitor having one end connected between the first and second transistors. The frequency boosting circuit biases a control terminal of the first transistor and receives feedback from the one end of the first capacitor.

In yet other features, the frequency boosting circuit comprises a third transistor having a control terminal that receives the cascode bias, a first terminal and a second terminal. A fourth transistor has a control terminal that receives the main bias, a first terminal that communicates with the second terminal of the third transistor and a second terminal.

In still other features, the frequency boosting circuit comprises a second capacitor having one end that communicates with the first terminal of the third transistor and an opposite end that communicates with the second terminal of the third transistor and with the one end of the first capacitor. The frequency boosting circuit comprises an inverter that has an input that communicates with the first terminal of the third transistor and an output that communicates with the control terminal of the first transistor.

In other features, the frequency boosting circuit comprises a first resistance having one end that communicates with the input of the inverter and an opposite end that communicates with the output of the inverter. The first and second transistors are metal-oxide semiconductor field-effect transistors (MOSFETs).

In other features, the frequency boosting circuit increases a bandwidth of the high swing cascode biasing circuit. The high swing cascode biasing circuit is implemented in an Ahuja compensation circuit.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
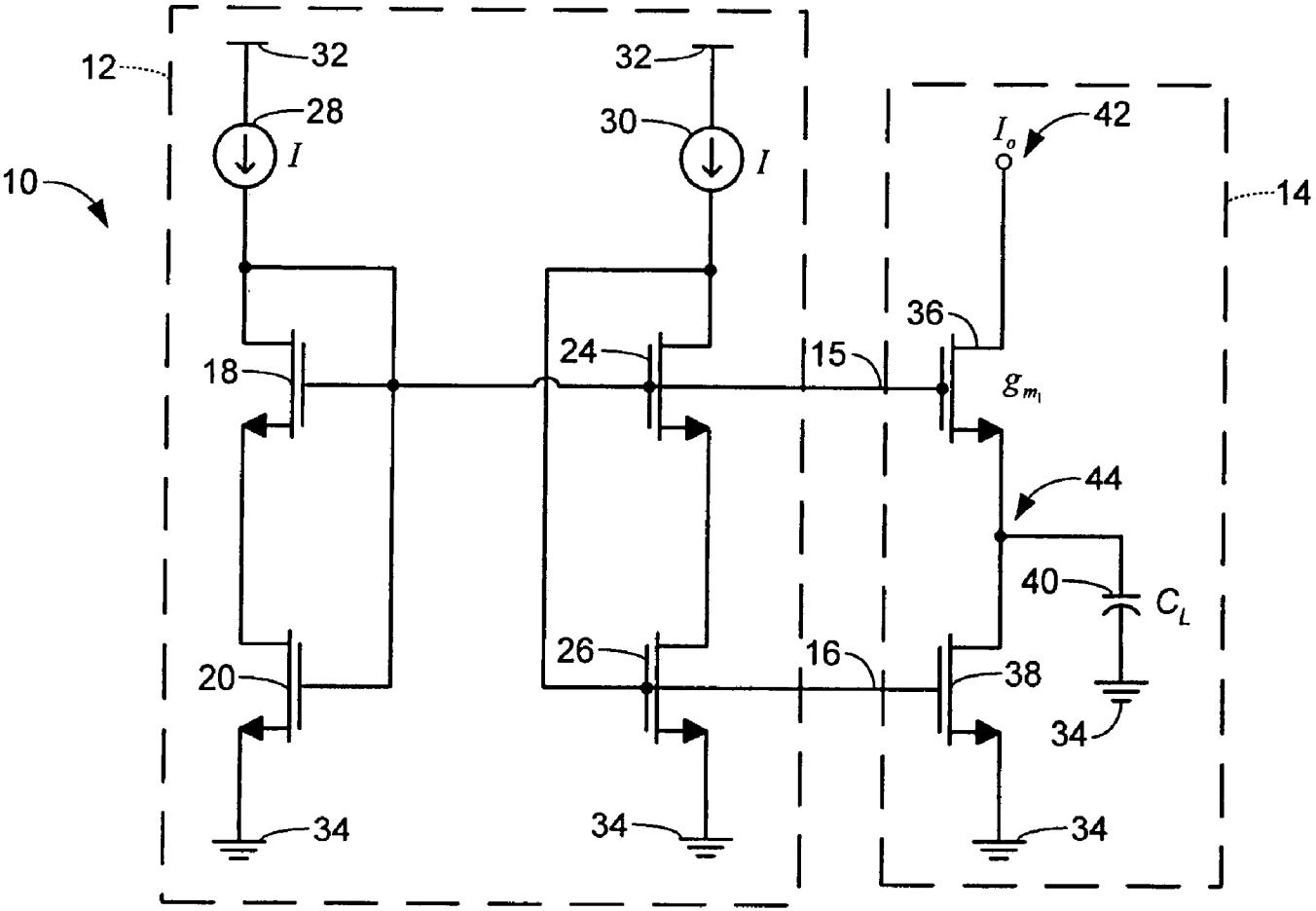
FIG. 1 Prior Art
FIG. 1 is an electrical schematic of a high swing cascode biasing circuit according to the prior art.
Figure 2A:
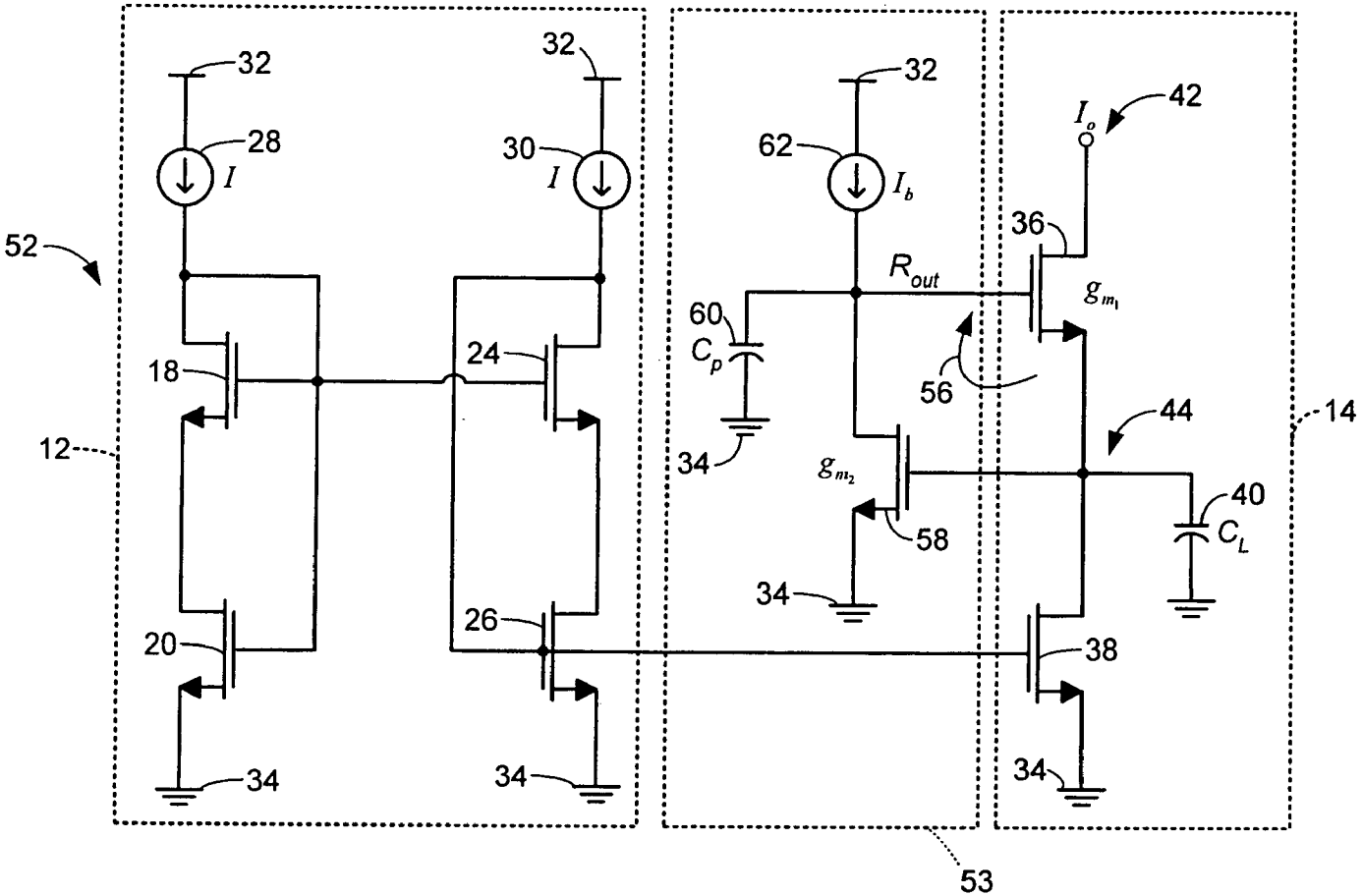
FIG. 2A Prior Art
FIG. 2A is an electrical schematic of a high swing cascode biasing circuit that includes an amplified feedback loop according to the prior art.
Figure 2B:
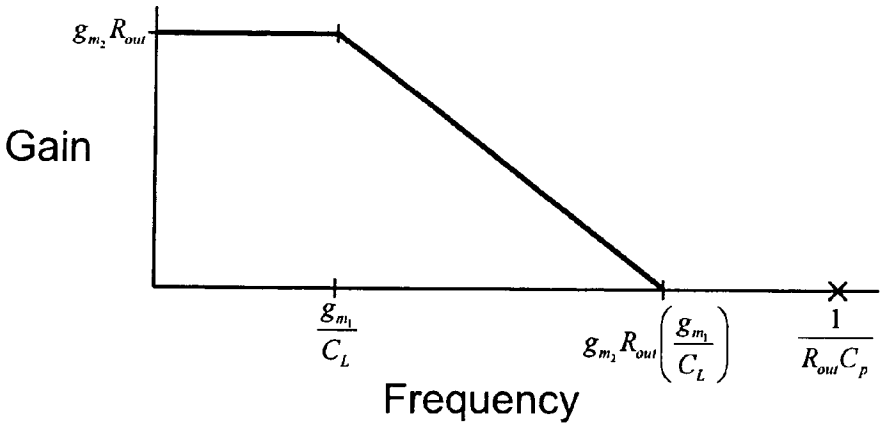
FIG. 2B Prior Art
FIG. 2B illustrates the open loop response of the circuit of FIG. 2A when a first pole is dominant.
Figure 2C:
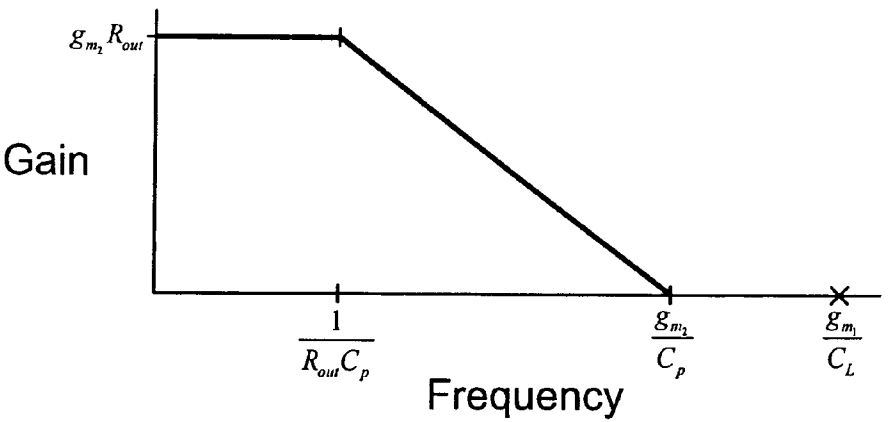
FIG. 2C Prior Art
FIG. 2C illustrates the open loop response of the circuit of FIG. 2A when a second pole is dominant.

The following description of the preferred embodiment(s) is merely exemplary in nature and is in no way intended to limit the invention, its application, or uses. For purposes of clarity, the same reference numbers will be used in the drawings to identify similar elements.

Figure 3A:
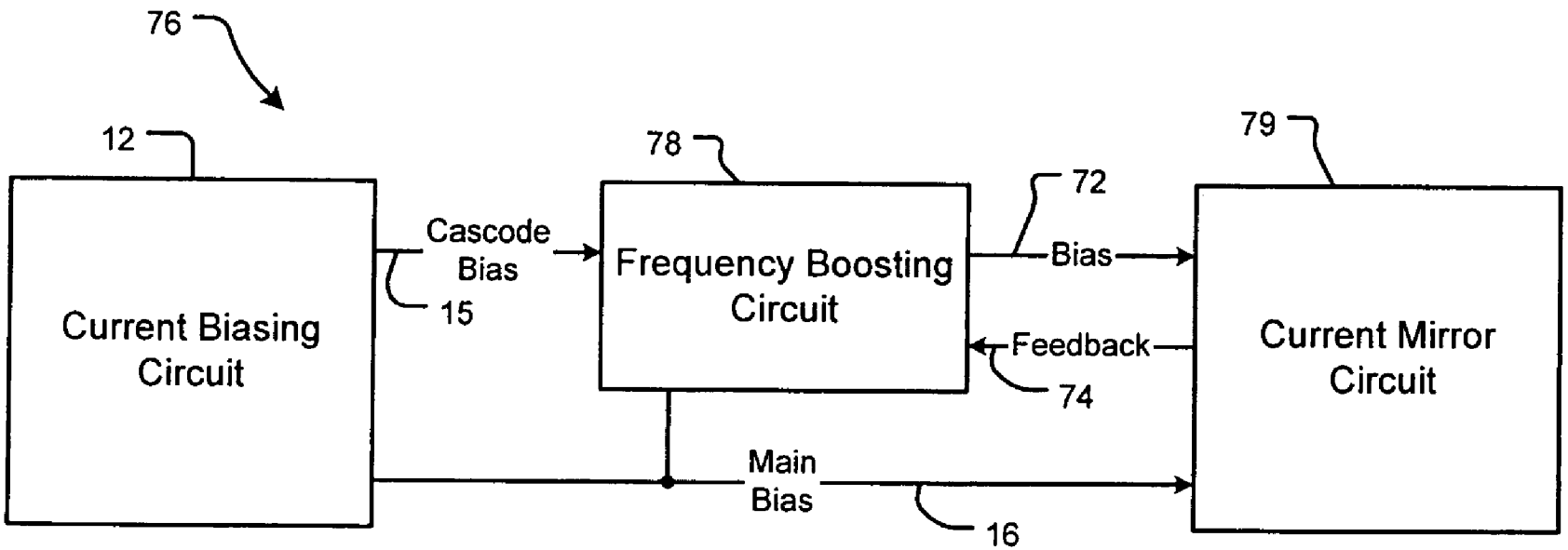
FIG. 3A is a functional block diagram of a high swing cascode biasing circuit with feedback according to the present invention.

Referring now to FIG. 3A, a high swing cascode biasing circuit 76 according to the present invention includes a frequency boosting circuit 78 that receives the cascode bias 15 and the main bias 16 from the current biasing circuit 12. The frequency boosting circuit 78 provides a bias signal 72 to and receives feedback signal 74 from a current mirror circuit 79.

Figure 3B:
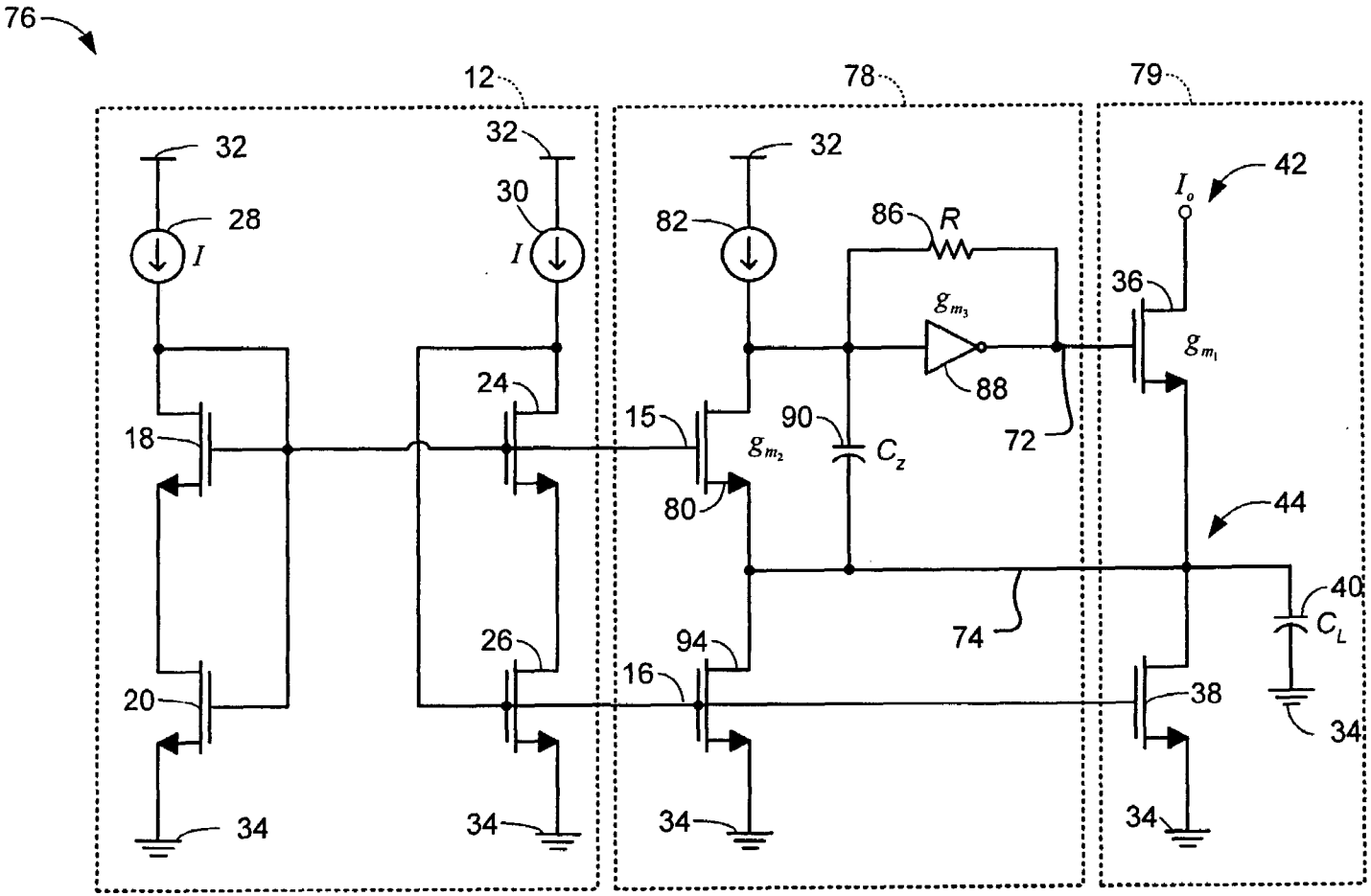
FIG. 3B is a more detailed electrical schematic of the high swing cascode biasing circuit of FIG. 3A.

Referring now to FIG. 3B, the frequency boosting circuit 78 includes a transistor 80 having a control terminal that receives the cascode bias 15 from the current biasing circuit 12. A first terminal or drain of the transistor 80 communicates with a current source 82 (which is biased by the voltage potential 32), a first end of a resistor 86, an input of an inverter 88 and a first end of a capacitance 90. A second terminal or source of the transistor 80 communicates with a second end of the capacitor 90, with the output node 44, and with a first terminal or drain of a transistor 94. A control terminal or gate of the transistor 94 receives the main bias 16 from the biasing circuit 12. An opposite end of the resistor 86 communicates with an output of the inverter 88 and with a control terminal or gate of the transistor 36 in the current mirror circuit 79. The transistors 80 and 94 may be metal-oxide semiconductor field-effect transistors (MOSFETs) that have gates, sources, and drains, although other transistor types may be used.

Figure 3C:
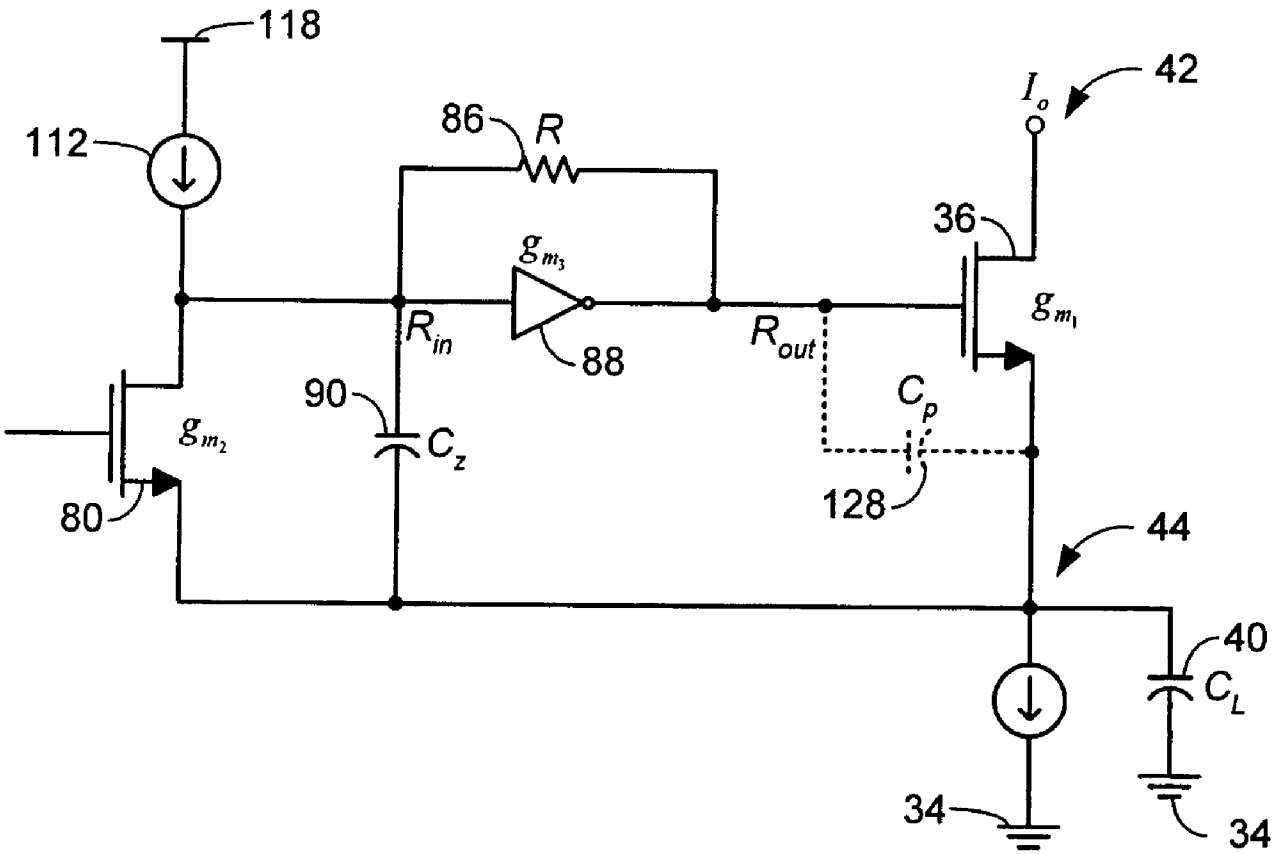
FIG. 3C is an equivalent circuit that further illustrates the operation of the high swing cascode biasing circuit in FIG. 3B.

Referring now to FIG. 3C, the frequency boosting circuit 78 of FIG. 3A ensures that internal poles occur at very high frequencies. When the open loop response technique is used there are two internal poles that occur at high frequencies. Both the input and output impedances of the inverting amplifier 88 are low because of the feedback loop. Therefore, a first pole that is produced by the inverting amplifier 88 and the capacitor 90 occurs at a higher frequency than a pole that is associated with the transistor 36 and the capacitor 40.

A parasitic capacitance $C_p$ 128 at the gate of the transistor 36 is associated with the low impedance of the inverting amplifier 88 and generates a pole that occurs at a high frequency. Since the capacitor 90 effectively shorts the transistor 80 when the frequency boosting circuit 78 operates at a high frequency, the pole, $$\frac{g_{m_1}}{C_L},$$

that is associated with the transistor 36 and the capacitor 40 is a dominant pole.

The frequency boosting circuit 78 of FIG. 3A is an improvement over conventional circuits that include two possible dominant poles. Internal poles occur at high frequencies due to the low input and output impedance of the inverting amplifier 88. Also, the capacitor 90 shorts the transistor 80 during high frequency operation, which adds a zero that increases the speed of the circuit.

Figure 4A:
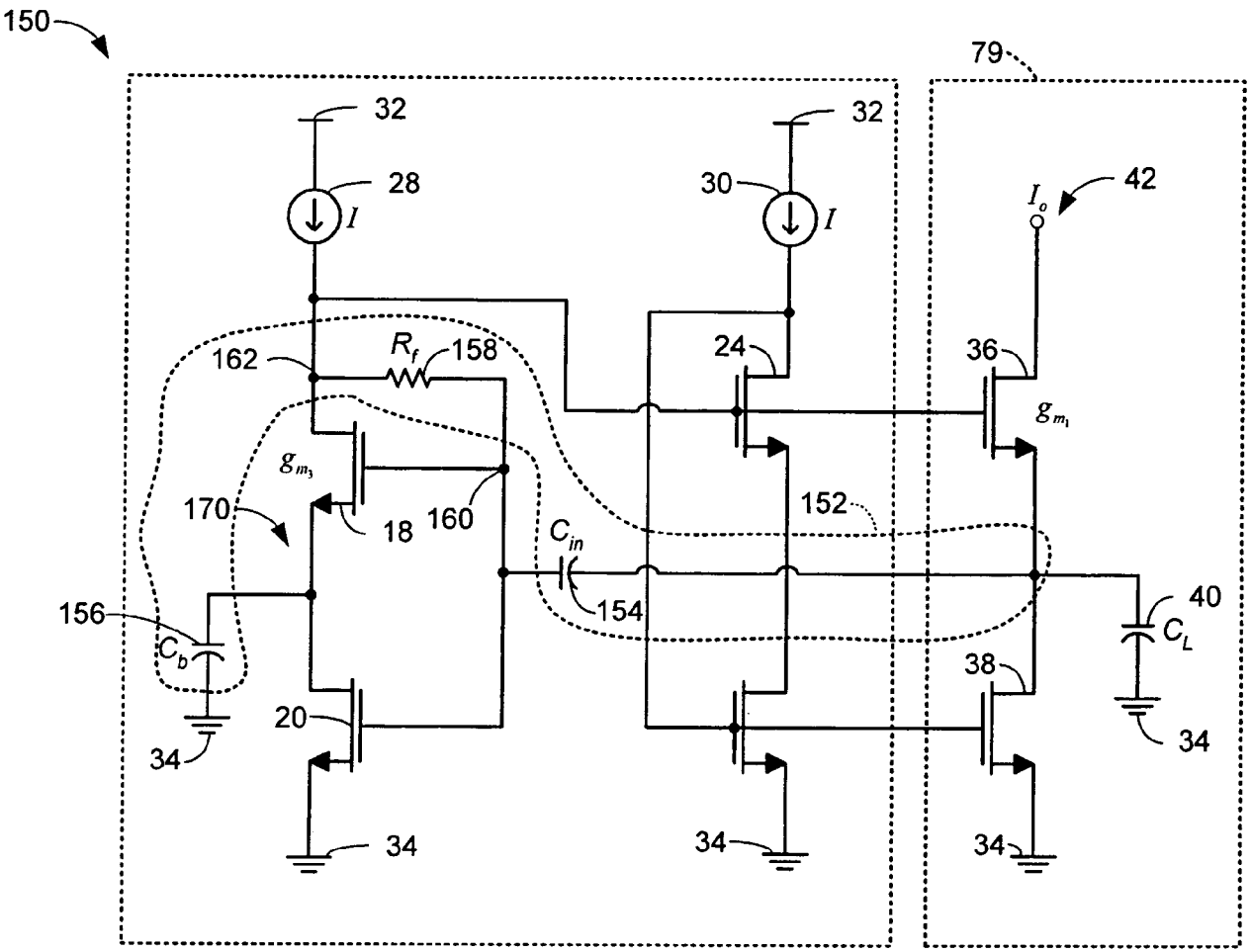
FIG. 4A is an electrical schematic of an alternate high swing cascode biasing circuit that includes a feedback loop according to the present invention.

Referring now to FIG. 4A, a high swing cascode biasing circuit 150 includes the components of the high swing cascode biasing circuit 10 that are shown in FIG. 1 and a frequency boosting components 152. The frequency boosting components 152 include a capacitor 154, a capacitor 156, and a resistor 158. Instead of shorting the drain and gate of the transistor 18 as in FIG. 1, the resistance $R_f$ 158 is connected between the gate of the transistor 18 and a drain of the transistor 18. The drain of the transistor 18 is connected to a gate of the transistor 24. The gate of the transistor 18 is capacitively coupled by the capacitor $C_f$ 154 to the output node 44. The capacitor $C_b$ 156 has one end that is connected to the source of transistor 18 and the drain of transistor 20 and an opposite end that is connected to the ground potential 34.

The capacitors 154 and 156, respectively, function as open-circuits during low frequency operation. Very little current flows to the gates of the transistors during low frequency operation. Therefore, little or no current flows through the feedback resistor 158 and the voltage drop across the feedback resistor 158 is approximately zero.

The configuration of the first transistor 18 and the feedback resistor 158 creates an amplifier with a feedback resistor that is somewhat similar to the arrangement in FIG.

3A. A node 160 at the second end of the feedback resistor 158 and the gate of the first transistor 18 is an input to the amplifier. A node 162 at the first end of the feedback resistor 158 and the drain of the first transistor 138 is the output of the amplifier. The feedback path increases the overall bandwidth, $$\frac{g_{m_1}}{C_L}.$$

The capacitors 154 and 156 are essentially short-circuits during high frequency operation. The capacitor 156 bypasses the transistor 20 during high frequency operation. The capacitor 154 creates a path from the gate of the first transistor 18 to the source of the fifth transistor 36. The capacitor 156 does not generate an internal pole. If the frequency boosting circuit 152 is implemented in a differential amplifier, the capacitor 156 may be omitted.

Figure 4B:
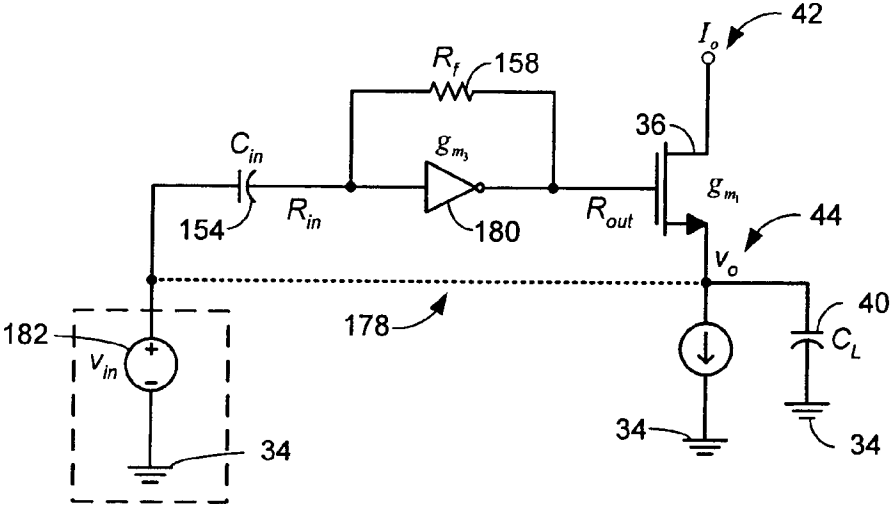
FIG. 4B is an equivalent circuit of the high swing cascode biasing circuit of FIG. 4A.

Referring now to FIG. 4B, an equivalent open loop and closed loop circuit of the high swing cascode biasing circuit 150 of FIG. 4A is shown. A dotted line indicates a closed feedback loop. The equivalent circuit includes an inverting amplifier 180. Little or no current enters the inverting amplifier 180 during low frequency operation due to the capacitor 154 effectively operating as an open circuit.

During high frequency operation, the second capacitor 154 functions as a short-circuit and current flows to the inverting amplifier 180. The inverting amplifier 180 has an input impedance and an output impedance. The input impedance is equal to $$R_{in} = \frac{1}{g_{m_3}}\left(1 + \left(\frac{R_f}{R_{out}}\right)\right).$$

Since the output impedance of the inverting amplifier 180 is very large, the input impedance is approximately equal to $$R_{in} = \frac{1}{g_{m_3}}.$$

A voltage source 182 generates current at an input of the inverting amplifier 180. The current is equal to the voltage divided by the input impedance of the inverting amplifier 180. During high frequency operation, the impedance of the capacitor 154 becomes very small as compared to the input impedance of the inverting amplifier 180. Therefore, the current that enters the inverting amplifier 180 during high frequency operation is equal to $$\frac{v_{in}}{\left(\frac{1}{g_{m_3}}\right)} = v_{in} g_{m_3}.$$

Current flows through the feedback resistor 158 and generates a voltage drop across the feedback resistor 158 that is equal to $v_{in}g_{m_3}R_f$. This voltage, $v_{in}g_{m_3}R_f$, appears at the output node 44. Current flows from the feedback resistor 158 to the transistor 36. The size of the feedback resistor 158, $R_f$, is preferably larger than $$\frac{1}{g_{m_3}}.$$

Figure 4C:
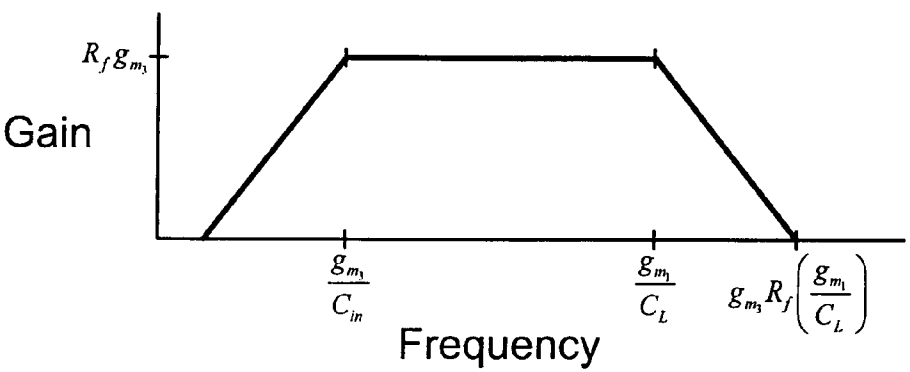
FIG. 4C illustrates the open loop response of the circuit in FIG. 4A.

Referring now to FIG. 4C, the open loop response technique is used to derive the bandwidth of the circuit in FIG. 4A. The DC gain of the open loop response is equal to $g_{m_3}R_f$, and a dominant pole exists at $$\frac{g_{m_1}}{C_L}.$$

Therefore, the crossover frequency is equal to $$g_{m_3} R_f \left(\frac{g_{m_1}}{C_L}\right).$$

In other words, the pole $$\frac{g_{m_1}}{C_L}$$

is moved upwards in frequency by the gain, $g_{m_3}R_f$. There is also sufficient separation between all other poles and crossover frequency. When the feedback loop is closed by the capacitor 154, the transconductance, $g_{m_1}$, of the transistor 36 is significantly increased.

Figure 5A:
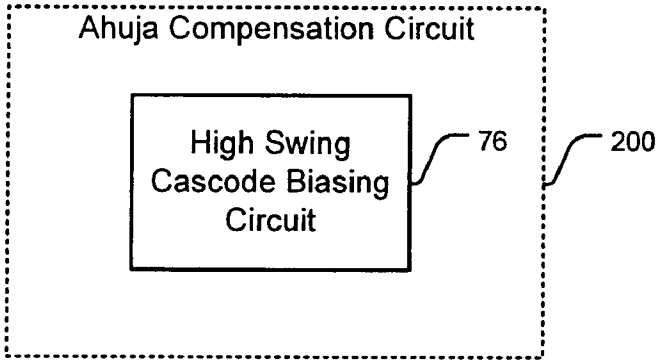
FIG. 5A illustrates the high swing cascode biasing circuit of FIG. 3B in an Ahuja compensation circuit.
Figure 5B:
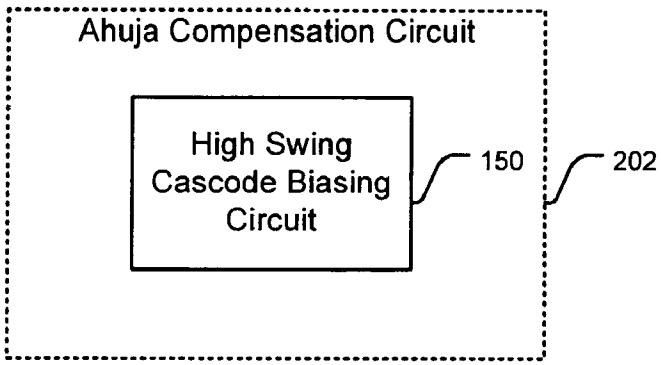
FIG. 5B illustrates the high swing cascode biasing circuit of FIG. 4A in an Ahuja compensation circuit.

Referring now to FIGS. 5A and 5B, the high swing cascode biasing circuits 76 and 150 of FIGS. 3A and 3B and 4A can be implemented in Ahuja compensation circuits 200 and 202, respectively. Still other implementations will be apparent to skilled artisans.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, specification, and the following claims.

What is claimed is:

1. A high swing cascode biasing circuit, comprising:

a current biasing circuit that generates a cascode bias and a main bias;

a frequency boosting circuit that receives said cascode bias and said main bias; and a current mirror circuit that receives said main bias, wherein said frequency boosting circuit biases said current mirror and receives feedback from said current mirror.

2. The high swing cascode biasing circuit of claim 1 wherein said current mirror circuit includes a first transistor, a second transistor and a first capacitance having one end connected between said first and second transistors and wherein said frequency boosting circuit biases a control terminal of said first transistor and receives feedback from said one end of said first capacitance.

3. The high swing cascode biasing circuit of claim 2 wherein said frequency boosting circuit comprises:

a third transistor that has a control terminal that receives said cascode bias, a first terminal and a second terminal; and a fourth transistor that has a control terminal that receives said main bias, a first terminal that communicates with said second terminal of said third transistor and a second terminal.

4. The high swing cascode biasing circuit of claim 3 wherein said frequency boosting circuit comprises a second capacitance having one end that communicates with said first terminal of said third transistor and an opposite end that communicates with said second terminal of said third transistor and with said one end of said first capacitance.

5. The high swing cascode biasing circuit of claim 4 wherein said frequency boosting circuit comprises an inverter that has an input that communicates with said first terminal of said third transistor and an output that communicates with said control terminal of said first transistor.

6. The high swing cascode biasing circuit of claim 5 wherein said frequency boosting circuit comprises a first resistance having one end that communicates with said input of said inverter and an opposite end that communicates with said output of said inverter.

7. The high swing cascode biasing circuit of claim 2 wherein said first and second transistors are metal-oxide semiconductor field-effect transistors (MOSFETs).

8. The high swing cascode biasing circuit of claim 2 wherein said feedback increases a transconductance of said first transistor.

9. The high swing cascode biasing circuit of claim 1 wherein said frequency boosting circuit increases a bandwidth of said high swing cascode biasing circuit.

10. An Ahuja compensation circuit comprising the high swing cascode biasing circuit of claim 1.

11. A high swing cascode biasing circuit, comprising:

current biasing means for generating a cascode bias and a main bias;

frequency boosting means for receiving said cascode bias and said main bias and for boosting a frequency response of said high swing cascode biasing circuit; and current mirror means for receiving said main bias, wherein said frequency boosting means biases said current mirror means and receives feedback from said current mirror means.

12. The high swing cascode biasing circuit of claim 11 wherein said current mirror means includes a first transistor, a second transistor and first capacitance means for providing a first capacitance and having one end connected between said first and second transistors and wherein said frequency boosting means biases a control terminal of said first transistor and receives feedback from said one end of said first capacitance means.

13. The high swing cascode biasing circuit of claim 12 wherein said frequency boosting means comprises:

a third transistor that has a control terminal that receives said cascode bias, a first terminal and a second terminal; and a fourth transistor that has a control terminal that receives said main bias, a first terminal that communicates with said second terminal of said third transistor and a second terminal.

14. The high swing cascode biasing circuit of claim 13 wherein said frequency boosting means comprises second capacitance means for providing a second capacitance and having one end that communicates with said first terminal of said third transistor and an opposite end that communicates with said second terminal of said third transistor and with said one end of said first capacitance means.

15. The high swing cascode biasing circuit of claim 14 wherein said frequency boosting means comprises inverting means for inverting that has an input that communicates with said first terminal of said third transistor and an output that communicates with said control terminal of said first transistor.

16. The high swing cascode biasing circuit of claim 15 wherein said frequency boosting means comprises first resistance means for providing a first resistance and having one end that communicates with said input of said inverter and an opposite end that communicates with said output of said inverter.

17. The high swing cascode biasing circuit of claim 12 wherein said first and second transistors are metal-oxide semiconductor field-effect transistors (MOSFETs).

18. The high swing cascode biasing circuit of claim 12 wherein said feedback increases a transconductance of said first transistor.

19. An Ahuja compensation circuit comprising the high swing cascode biasing circuit of claim 11.

* * * * *